US009132646B2

(12) United States Patent
Mitsuo

(10) Patent No.: US 9,132,646 B2
(45) Date of Patent: Sep. 15, 2015

(54) LIQUID DISPENSING APPARATUS

(71) Applicant: SEIKO EPSON CORPORATION, Tokyo (JP)

(72) Inventor: Noritaka Mitsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/190,911

(22) Filed: Feb. 26, 2014

(65) Prior Publication Data

US 2014/0285583 A1 Sep. 25, 2014

(30) Foreign Application Priority Data

Mar. 21, 2013 (JP) ..... 2013-058444

(51) Int. Cl.
*B41J 2/175* (2006.01)
*B41J 29/38* (2006.01)

(52) U.S. Cl.
CPC . *B41J 2/175* (2013.01); *B41J 29/38* (2013.01)

(58) Field of Classification Search
USPC ..... 347/5, 7, 85; 141/2, 18
See application file for complete search history.

(56) References Cited

U.S. PATENT DOCUMENTS

| | | | | |
|---|---|---|---|---|
| 5,469,201 | A * | 11/1995 | Erickson et al. | 347/85 |
| 5,489,931 | A * | 2/1996 | Shibata et al. | 347/85 |
| 6,003,981 | A * | 12/1999 | Cameron et al. | 347/85 |
| 6,338,553 | B1 * | 1/2002 | Lewis et al. | 347/85 |
| 7,175,264 | B2 * | 2/2007 | Qingguo et al. | 347/85 |
| 7,306,329 | B2 * | 12/2007 | Watarai | 347/85 |
| 7,891,762 | B2 * | 2/2011 | Nakano et al. | 347/33 |
| 8,087,764 | B2 * | 1/2012 | Niimi | 347/85 |
| 8,646,885 | B2 * | 2/2014 | Ishizawa et al. | 347/85 |

FOREIGN PATENT DOCUMENTS

JP 2007-160749 6/2007

* cited by examiner

*Primary Examiner* — Anh T. N. Vo
(74) *Attorney, Agent, or Firm* — Workman Nydegger

(57) ABSTRACT

A liquid dispensing apparatus includes a head that dispenses a liquid containing a sedimentary substance, a liquid tank for storing the liquid, a liquid supply path through which the liquid is supplied from the ink tank to the head via a section having a level difference larger than a predetermined distance in a vertical direction, the section including one or more bent portions including a bent portion of a first type where a downward flow of the liquid is turned to an upward flow, and a bent shape conversion unit configured to change a shape of the section with the level difference, so as to convert the bent portion of the first type in the section with the level difference before the shape conversion into a bent portion of a second type where an upward flow of the liquid is turned to a downward flow.

7 Claims, 9 Drawing Sheets

LIQUID DISPENSING APPARATUS

BACKGROUND

1. Technical Field

The present invention relates to a liquid dispensing apparatus.

2. Related Art

Liquid dispensing apparatuses thus far known include an ink jet image forming apparatus configured to dispense ink, an example of the liquid, from a head to thereby form an image. Many of such ink jet image forming apparatuses include an ink supply path through which the ink is supplied from an ink tank in which the ink is stored to the head that dispenses the ink, for example as disclosed in JP-A-2007-160749. For example, the ink jet printing apparatuses for industrial use, particularly large-scale printing apparatus designed for large sheet printing, consume a large amount of ink and therefore generally an ink tank capable of storing a large amount of ink is provided separately from the head, and a tubular ink supply path is arranged between the head and the ink tank.

In such ink jet image forming apparatuses, the ink supply path may include a section where there is a level difference in a vertical direction. In the case of the ink jet printing apparatuses for industrial use in particular, the level difference in the vertical direction often exceeds 100 mm, and in the large-scale printing apparatuses the level difference may even exceed 300 mm.

Now, in some types of ink used in the ink jet image forming apparatuses, a pigment component contained in the ink is prone to precipitate (hereinafter the precipitation of the pigment component in the ink will be simply referred to as precipitation of ink), and therefore a difference in ink density is prone to be produced in the ink. For example, white ink is a kind of such sedimentary ink. The precipitation of the ink more actively takes place in the section of the ink supply path having a level difference, and in case that an image is outputted with the ink in which the precipitation is prominent, the density of the outputted image largely deviates from the expectation thereby significantly degrading the picture quality. Such a drawback is especially critical with the ink jet printing apparatuses in which the ink supply path has a large level difference in the vertical direction.

One of the measures to suppress the precipitation of the ink to thereby homogenize ink density is forming some stepped portions in the section of the ink supply path where there is a level difference. By forming the stepped portions, locations where the precipitation of the ink is relatively more active and locations where the precipitation of the ink is relatively less active are dispersed in a plurality of locations, which suppresses appearance of an extreme difference in ink density.

However, although appearance of an extreme difference in ink density can be suppressed by forming the stepped portions, at some locations, for example a bottom portion or a corner portion of the stepped portion, the precipitation of the ink still takes place. Accordingly, a certain extent of difference in ink density still remains, which may affect the picture quality. Thus, from the viewpoint of improvement of the picture quality, forming the stepped portions in the sections where there is a level difference is insufficient for homogenizing the ink density, and therefore a more effective measure for homogenizing the ink density is being sought for.

SUMMARY

An advantage of some aspects of the present invention is provision of a liquid dispensing apparatus that includes a liquid supply path configured to improve homogeneity in density of a liquid containing a sedimentary substance, typically ink containing a sedimentary pigment component.

In an aspect, the present invention provides a liquid dispensing apparatus including a head that dispenses a liquid containing a sedimentary substance, a liquid tank for storing the liquid, a liquid supply path through which the liquid is supplied from the ink tank to the head via a passage having a level difference larger than a predetermined distance in a vertical direction, the section with the level difference including one or more bent portions including a bent portion of a first type where a downward flow of the liquid is turned to an upward flow, and a bent shape conversion unit configured to change a shape of the liquid supply path with respect to the section with the level difference, so as to convert the bent portion of the first type in the section with the level difference before the shape conversion, into a bent portion of a second type where an upward flow of the liquid is turned to a downward flow.

Generally, the sedimentary substance in the liquid is prone to precipitate in the vicinity of the bent portion of the first type where the downward flow of the liquid is turned to the upward flow, and hence the precipitation is relatively active. In contrast, the sedimentary substance in the liquid barely precipitates in the vicinity of the bent portion of the second type where the upward flow of the liquid is turned to the downward flow, and hence the precipitation barely takes place.

In the liquid dispensing apparatus configured as above, the sedimentary substance in the liquid precipitates at the bent portion of the first type before the shape conversion. However, after the bent portion of the first type is converted into the bent portion of the second type by the bent shape conversion unit, the sedimentary substance in the liquid starts to flow downward from the bent portion of the second type. Accordingly, the liquid is actually stirred, and therefore the density of the liquid becomes more homogeneous in the passage including the bent portion. Thus, the foregoing liquid dispensing apparatus provides improved homogeneity in density of the liquid, compared with the case where merely one or more bent portions are provided and the shape conversion is not performed.

In the foregoing liquid dispensing apparatus, preferably the liquid supply path may be formed of a flexible tube and allows the liquid to pass through inside the tube to thereby supply the liquid from the liquid tank to the head, and may further include one or more support members that respectively support the one or more bent portions to thereby determine the shape of the section with the level difference of the liquid supply path.

With the mentioned configuration, the support members contribute to stabilizing the shape of the liquid supply path.

More preferably, the bent shape conversion unit may be configured to perform the shape conversion by moving, out of the one or more support members, a second support member supporting the bent portion of the first type relatively with respect to a first support member supporting the bent portion other than the bent portion of the first type, out of the one or more support members.

The mentioned more preferable configuration enables the shape conversion in the liquid dispensing apparatus to be easily performed by simply moving the second support member relatively with respect to the first support member.

The mentioned configuration may be arranged as first to third application examples cited hereunder. First, the bent shape conversion unit may include a plate-shaped member having the first support member fixed to a surface thereof and including a slit linearly extending so as to allow the second support member to be inserted, the plate-shaped member supporting the second support member inserted in the slit, so as to allow the second support member to linearly move in the extending direction of the slit, and a driving unit configured to perform the shape conversion by linearly driving the second support member supported by the plate-shaped member in the extending direction of the slit.

Second, the bent shape conversion unit may include a first plate-shaped member having the first support member fixed to a surface thereof, a second plate-shaped member having the second support member fixed to a surface thereof and including a slit linearly extending so as to allow the first support member fixed to the first plate-shaped member to be inserted, the second plate-shaped member being configured to be driven to linearly move in the extending direction of the slit relatively with respect to the first support member inserted in the slit, and a driving unit configured to perform the shape conversion by linearly driving the second plate-shaped member in the extending direction of the slit thereby linearly moving the second support member relatively with respect to the first support member in the slit.

Third, the bent shape conversion unit may include a plate-shaped member having the first support member fixed to a surface thereof, a frame member having the second support member fixed thereto and configured to be made to pivot by a rotational driving force, such that the position where the second support member is fixed is made to pivot about a rotation axis coinciding with a straight line on the plate-shaped member passing the position where the first support member is fixed, and a driving unit configured to perform the shape conversion by driving the frame member to pivot so as to make the second support member relatively pivot with respect to the first support member.

The first to the third application examples cited above enable the shape conversion to be performed with a simple structure.

Preferably, the foregoing liquid dispensing apparatus may further include a control unit configured to cause the bent shape conversion unit to perform the shape conversion and restore the initial shape of the liquid supply path by reverse conversion of the shape of the liquid supply path after the shape conversion.

The one or more bent portions may include the bent portion of the second type, in which case the bent portion that had the second shape before the shape conversion is converted into the bent portion of the first type, upon performing the shape conversion. In the bent portion of the first type newly formed after the shape conversion, the precipitation of the sedimentary substance in the liquid becomes relatively more active. With the mentioned preferred configuration, however, since the initial shape is restored through the reverse conversion of the liquid supply path, the bent portion of the first type newly formed after the shape conversion again assumes the second shape. Therefore, the precipitation of the sedimentary substance in the newly formed bent portion of the first type can be avoided, and consequently the homogeneity in density in the liquid supply path can be improved.

More preferably, the control unit may be configured to alternately perform the shape conversion and the reverse conversion at predetermined time intervals.

In this case, the precipitation of the sedimentary substance in the bent portion of the first type disappears at the predetermined time intervals. Therefore, the homogeneity in density in the liquid supply path can be further improved.

Other features of the present invention will become more apparent through description of embodiments given hereunder with reference to the drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereafter, a first embodiment of the liquid dispensing apparatus according to the present invention will be described. The first embodiment corresponds to the first application example cited above.

Figure 1:
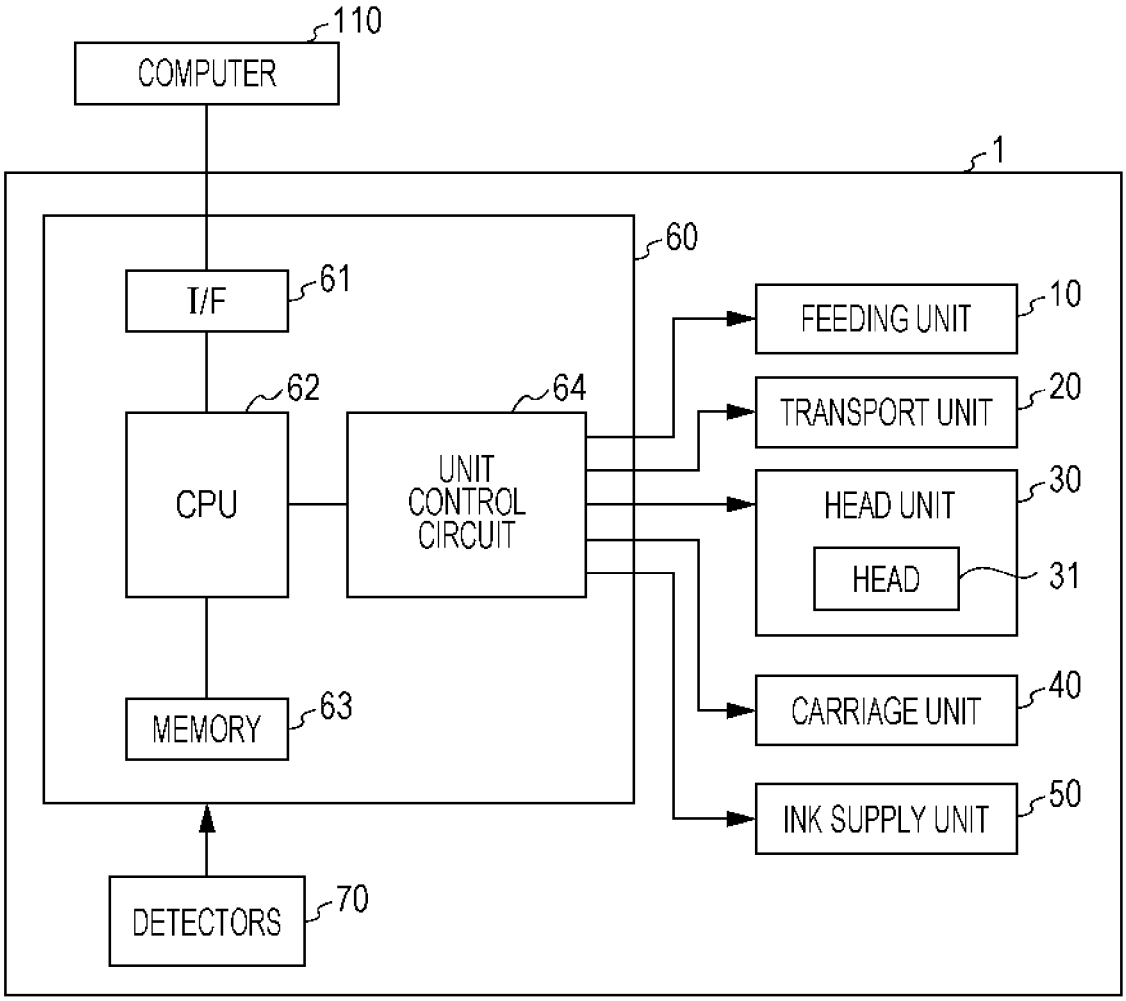
FIG. 1 is a block diagram showing a configuration of an ink jet printer, exemplifying a liquid dispensing apparatus according to a first embodiment of the present invention.

FIG. 1 is a block diagram showing a configuration of an ink jet printer (hereinafter, simply printer) 1, exemplifying a liquid dispensing apparatus according to the first embodiment.

The printer 1 shown in FIG. 1 is compatible with a roll of paper (continuous rolled paper) as a medium on which an image is to be outputted. The following description is based on the case of outputting an image onto the rolled paper.

As show in FIG. 1, the printer 1 includes a feeding unit 10, a transport unit 20, a head unit 30, a carriage unit 40, an ink supply unit 50, a controller 60 that controls the mentioned units to manage the operation of the printer 1, and detectors 70.

The feeding unit 10 serves to deliver the rolled paper to the transport unit 20. The feeding unit 10 includes a paper shaft (not shown) on which the rolled paper is wound and rotatably supported, and rollers (not shown) with which the paper drawn out from the paper shaft is engaged to be guided to the transport unit 20.

The transport unit 20 serves to transport the rolled paper delivered from the feeding unit 10 along a predetermined transport route. The transport unit 20 includes a plurality of rollers (not shown) disposed along the transport route, transport motors (not shown) that rotate those rollers, and a platen (not shown) that supports a portion of the rolled paper located in the printing region on the transport route. When the rolled paper moves sequentially passing through the rollers the transport route for the rolled paper is defined, and the rolled paper is intermittently transported along the transport route by the transport unit 20, by a unit distance corresponding to the printing region.

The head unit 30 is configured to dispense a plurality of color inks toward the printing region (platen) on the transport route, to thereby print an image on the rolled paper. To be more detailed, the head unit 30 dispenses the color inks through ink dispensing nozzles onto the portion of the rolled paper introduced into the printing region by the transport unit 20, to thereby form an image on the rolled paper. In this embodiment, the head unit 30 a plurality (M) of heads 31, respectively corresponding to the color inks.

Each of the heads 31 includes a plurality of ink dispensing nozzle rows each composed of ink dispensing nozzles aligned, on the lower face (nozzle face). In this embodiment, the nozzle rows respectively correspond to colors such as yellow, magenta, cyan, black, and white, and each include a plurality of ink dispensing nozzles from #1 to #N. In the following description, the ink other than the white ink, i.e., yellow, magenta, cyan, and black ink will be referred to as color ink.

The white ink is employed for printing the background (white color) of the color image, for example when the printing is performed on a transparent medium. Printing thus the white background makes the color image more clearly visible. The white ink contains a white pigment, corresponding to the sedimentary substance in the present invention, as color material. Examples of the material of the white pigment include a metal oxide, barium sulfate, and calcium carbonate. Examples of the metal oxide include titanium dioxide, zinc oxide, silica, alumina, magnesium oxide, and so forth. Among those cited above, the titanium dioxide is preferable from the viewpoint of quality of whiteness. The white ink is prone to be thickened or hardened when kept still for a long time. In addition, the white ink is a sedimentary ink in which the pigment is prone to precipitate when kept still for a long time. Here, the sedimentary ink refers to those that suffer a decline of absorbance to 95% or less within 24 hours.

The nozzles #1 to #N of each nozzle row are linearly aligned in a direction intersecting the transport direction of the rolled paper. Such intersecting direction may hereafter be referred to as width direction. The nozzle rows are aligned parallel to each other with a spacing therebetween, in the transport direction. The nozzles #1 to #N each include a piezoelectric element (not shown) that serves as driving element to dispense an ink droplet. When a voltage of a predetermined time width is applied between electrodes provided at the respective end portions of the piezoelectric element, the piezoelectric element expands in proportion to the application time of the voltage, thereby deforming the sidewall of the ink supply path. Accordingly, the volume of the ink supply path increases and decreases with the expansion and contraction of the piezoelectric element, and an amount of ink corresponding to the contraction is dispensed through each of the nozzles #1 to #N in the form of ink droplet. M pieces of such heads 31 are aligned in the width direction, thus constituting the head unit 30. Therefore, the head unit 30 includes M×N nozzles in total.

The carriage unit 40 serves to move the head unit (i.e., the heads 31). The carriage unit 40 includes a carriage guide rail (not shown) extending in the transport direction, a carriage (not shown) supported by the carriage guide rail so as to reciprocate in the transport direction, and a motor (not shown) that drives the carriage. The carriage includes the head unit 30 (i.e., the heads 31) mounted therein, and is driven by the motor so as to move in the transport direction together with the head unit 30.

The ink supply unit 50 is to supply the ink to the head unit 30 when the amount of ink in the head unit 30 is reduced because of the consumption of the ink. The ink supply unit 50 includes ink cartridges, flexible ink supply tubes serving as the supply path of the respective color inks, and a shape conversion mechanism (described later) that changes the shape of the ink supply tube. The details of the ink supply unit 50 will be subsequently described.

The controller 60 is a control unit for controlling the printer 1. The controller 60 includes, as shown in FIG. 1, an interface (I/F) unit 61, a CPU 62, a memory 63, and a unit control circuit 64. The I/F unit 61 serves for transmission and reception of data between the printer 1 and a computer 110 which is an external device. The CPU 62 is an arithmetic processing unit for controlling the overall operation of the printer 1. The memory 63 provides a region for storing the programs of the CPU 62 and an operational region. The CPU 62 controls the mentioned units utilizing the unit control circuit 64 arranged according to the program stored in the memory 63. The controller 60 also serves to control the shape conversion mechanism in the ink supply unit 50 so as to perform shape conversion of the ink supply tube, as will be subsequently described.

The detectors 70 serve to monitor conditions in the printer 1 and includes, for example, a sensor for detecting a slack of the rolled paper, a rotary encoder attached to the transport roller for controlling the transport operation of the rolled paper, a paper sensor for detecting the presence of the rolled paper being transported, a linear encoder for detecting the position of the carriage (heads 31) in the transport direction, and an edge sensor for detecting the position of the edges of the rolled paper in the width direction.

The printing operation of the printer 1 will now be described. In the printing operation, the controller 60 receives a printing command and performs paper feed control, dot formation control, and transport control, and then makes decision on paper discharge and completion of printing. The functional units in the printer 1 cited above with reference to FIG. 1 execute the respective tasks in accordance with the operation of the controller 60. The operation of the controller 60 and the process performed by each of the units will be briefly described hereunder.

The reception of the printing command refers to receiving the printing command from the computer 110 through the I/F unit 61.

The paper feed control includes moving the rolled paper which is the object of printing along the transport route, and setting the rolled paper at the position to start the printing, so called cueing position. In the paper feed control, the controller 60 controls the driving of the transport motor in the transport unit 20, so as to move the rolled paper.

The dot formation control is performed for forming dots on the rolled paper. In the dot formation control, the controller 60 controls the carriage unit 40 so as to drive the carriage, and outputs a control signal to each of the heads 31 in the head unit 30. The piezoelectric element in each of the nozzles in the head 31 is driven according to the control signal, so that the ink is dispensed through the nozzles onto the rolled paper. By the dot formation control, the dots are formed on the rolled paper in the direction in which the carriage is driven.

The transport control is performed for moving the rolled paper in the transport direction. The controller 60 causes the transport unit 20 to intermittently transport the rolled paper along the transport route (in the transport direction), by a predetermined unit distance corresponding to a length of one page. Accordingly, new dots are formed on the rolled paper at a position shifted from the position the previously formed dots, in the transport direction of the rolled paper.

The decision on completion of printing is made to determine whether the printing is to be continued. The controller 60 makes the decision on whether to continue the printing according to whether printing data for the rolled paper is still available.

Hereunder, the configuration of the ink supply unit 50 will be described in details.

Figure 2:
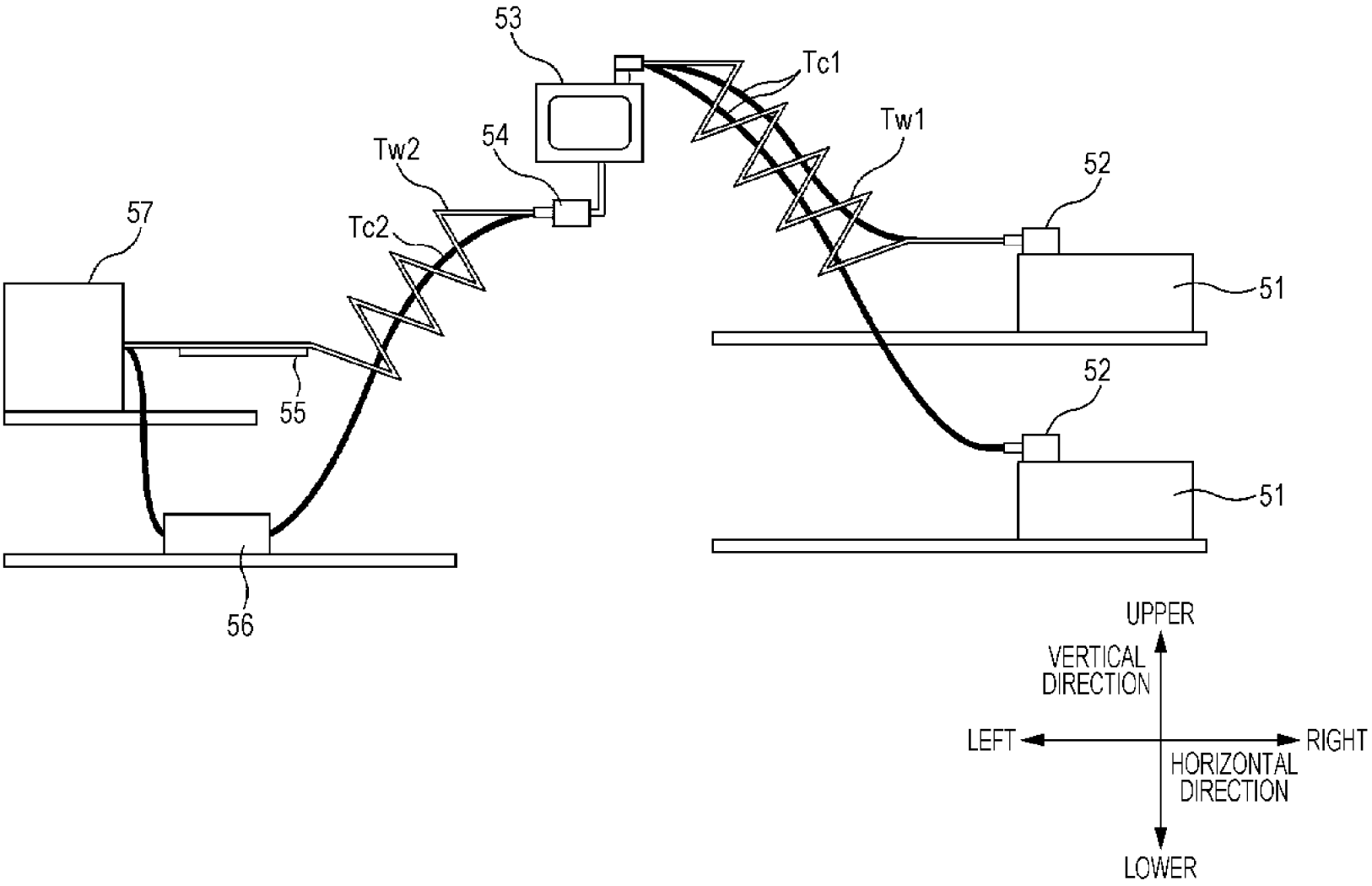
FIG. 2 is a schematic drawing showing a configuration of an ink supply unit employed in the ink jet printer shown in FIG. 1.

FIG. 2 schematically illustrates the arrangement of the ink supply unit 50 shown in FIG. 1.

To simplify the description, an up-down direction (vertical direction) and a left-right direction (horizontal direction) indicated by arrows in FIG. 2 will be adopted as reference in the description given below.

The ink supply unit 50 includes ink cartridge chambers 51, cartridge-side electromagnetic valves 52, a relay tank 53, a relay tank-side electromagnetic valve 54 a support table 55, a cable duct 56, and a cableveyor (registered trademark) 57.

The ink supply unit 50 also includes ink supply tubes for supplying therethrough the white ink and the color inks. Among the ink supply tubes routed between each of the ink cartridge chambers 51 and the relay tank 53 shown in FIG. 2, the ink supply tube Tw1 bent in a zigzag shape is used for the white ink. The ink supply tube for the inks other than the white ink, i.e. for the color inks is collectively denoted as ink supply tube Tc1. Likewise, among the ink supply tubes routed between the relay tank 53 and the entrance of the cableveyor (registered trademark) 57, the ink supply tube Tw2 bent in a zigzag shape is used for the white ink, and the ink supply tube for the inks other than the white ink, i.e. for the color inks is collectively denoted as ink supply tube Tc2. The ink supply tubes Tc1, Tw1, Tc2, Tw2 are constituted of a flexible hollow tube, and the ink of each color is supplied by allowing the ink to pass through inside the tube. Here, the ink supply tubes Tw1, Tw2 for the white ink correspond to the liquid supply path in the present invention.

The ink cartridge chambers 51 each store therein ink cartridges (not shown) of the respective colors, and are located at a right lower position in FIG. 2. The ink cartridge chambers 51 include an upper stage and a lower stage, on each of which a plurality of ink cartridges are mounted. The ink cartridge chambers 51 each supply the ink in the ink cartridges to the relay tank 53 through the ink supply tubes Tc1 and Tw1, with a non-illustrated pump.

The ink cartridge of the white ink is mounted in the ink cartridge chamber 51 on the upper stage. This is because it is desirable to reduce the level difference in the up-down (vertical) direction between the relay tank 53 and the ink cartridge of the white ink, from the viewpoint of suppressing the precipitation of the pigment component as much as possible. The ink cartridges of the color inks are located at predetermined positions in the ink cartridge chamber 51 on the upper or lower stage, since it is not mandatory to take the precipitation of the pigment component into account. Between the ink cartridge chambers 51 on the upper and lower stages, the one on the upper stage in which the ink cartridge of the white ink is mounted corresponds to the liquid tank in the present invention.

The cartridge-side electromagnetic valve 52 is attached to the ink cartridge chamber 51, and opens and closes the ink supply tubes Tc1, Tw1 under the control of the controller 60 shown in FIG. 1. The supply of the ink from the ink cartridge chamber 51 to the relay tank 53 is controlled by the opening and closing action of the electromagnetic valve 52. A plurality of cartridge-side electromagnetic valves 52 are provided, for the ink cartridges of the respective color inks mounted in the ink cartridge chamber 51. In other words, although the ink supply tube Tc1 for the color inks on the upper stage and the ink supply tube Tw1 for the white ink are connected to a single cartridge-side electromagnetic valve 52 on the upper stage in FIG. 2, and also the ink supply tube Tc1 for the color inks on the lower stage is connected to a single cartridge-side electromagnetic valve 52 on the lower stage in FIG. 2, actually the ink supply tubes for the respective colors are individually connected to the corresponding one of the plurality of cartridge-side electromagnetic valves 52.

The relay tank 53 is located between the ink cartridge chamber 51 and the cableveyor (registered trademark) 57, at an upper position therefrom in the vertical direction, so as to supply the ink to the head unit 30 through the ink supply tubes Tc2, Tw2, utilizing hydraulic head difference. The inks supplied to the relay tank 53 from the ink cartridge chambers 51 are stored in the respective designated regions.

The relay tank-side electromagnetic valve 54 is located under the relay tank 53, and opens and closes the supply path of the ink supply tubes Tc2, Tw2 under the control of the controller 60. A plurality of relay tank-side electromagnetic valves 54 are provided, for the respective regions allocated to the color inks in the relay tank 53. In other words, although the ink supply tube Tc2 for the color inks and the ink supply tube Tw2 for the white ink on the left in FIG. 2 are connected to a single relay tank-side electromagnetic valve 54, actually the ink supply tubes for the respective colors are individually connected to the corresponding one of the plurality of relay tank-side electromagnetic valves 54.

The cable duct 56 serves to bundle the ink supply tubes Tc2 for the color inks (illustrated as a single tube in FIG. 2 but actually a plurality of tubes) to prevent the tubes from coming apart from each other, and is located between the relay tank 53 and the cableveyor (registered trademark) 57 at a position lower than the cableveyor (registered trademark) 57, for the sake of convenience in the maintenance work.

The cableveyor (registered trademark) 57 is configured to move in a caterpillar-like motion following up the displacement of the carriage. The cableveyor (registered trademark) 57 is located at a left lower position from the relay tank 53, and left upper position from the cable duct 56. The cableveyor (registered trademark) 57 retains therein the ink supply tubes Tc2, Tw2 for the respective color inks, and configured to move within a predetermined range. The ink supply tubes are connected to the respective heads 31 (see FIG. 1) in the carriage in the carriage unit 40 (see FIG. 1), through the cableveyor (registered trademark) 57. Among the heads 31 corresponding to the respective color inks, the one corresponding to the white ink exemplifies the head in the present invention.

The support table 55 is located at a position lower than the relay tank 53 and upper than the cable duct 56, and serves to support the ink supply tube Tw2 for the white ink extending from the relay tank 53 at a predetermined level in the vertical direction so as to guide the ink supply tube Tw2 to the cableveyor (registered trademark) 57. Among the ink supply tubes Tc2, Tw2, only the ink supply tube Tw2 for the white ink is routed along the support table 55 instead of through the cable duct 56, because it is desirable to reduce the level difference in the up-down (vertical) direction in the path of the ink supply tube Tw2 for the white ink, from the viewpoint of suppressing the precipitation of the pigment component in the white ink as much as possible.

Further, though not shown in FIG. 2, the ink supply unit 50 shown in FIG. 1 also includes the shape conversion mechanism that changes the zigzag shape of the ink supply tubes Tw1, Tw2.

The ink supply unit 50 shown in FIG. 1 is configured as described above.

Hereunder, the configuration of the shape conversion mechanism that performs the shape conversion of the ink supply tubes Tw1, Tw2, as well as the advantageous effects will be described.

In the ink supply unit 50 shown in FIG. 1, the ink supply tubes Tw1, Tw2 for the white ink are formed with a level difference in the vertical direction, as shown in FIG. 2. As stated earlier, the pigment component in the white ink employed in the printer 1 shown in FIG. 1 is prone to precipitate, and generally the precipitation of the ink more actively takes place in a section of the ink supply path having a level difference. In case that an image is outputted with the ink in which the precipitation is prominent, the density of the outputted image largely deviates from the expectation owing to the difference in ink density originating from the precipitation of the ink, thereby significantly degrading the picture quality.

Now, as shown in FIG. 2, the ink supply tubes Tw1, Tw2 for the white ink, disposed with a certain level difference, are formed in a zigzag shape including bent portions where the ink flow direction is alternately changed in the vertical direction. By alternately changing the ink flow direction in the vertical direction, the bent portions where the precipitation of the ink is relatively more active (typically, where a downward flow of the ink is turned to an upward flow) and the bent portions where the precipitation of the ink is relatively less active (typically, where an upward flow of the ink is turned to a downward flow) are dispersed in a plurality of locations, which suppresses appearance of an extreme difference in ink density.

However, although appearance of an extreme difference in ink density can be suppressed by forming the bent portions where the ink flow direction is changed in the vertical direction, the precipitation of the ink still takes place at some locations. Accordingly, a certain extent of difference in ink density still remains, which may affect the picture quality. Thus, from the viewpoint of improvement of the picture quality, forming the zigzag shape in a part of the ink supply tube where there is a level difference is insufficient for homogenizing the ink density, and therefore a more effective measure has to be taken for homogenizing the ink density.

Accordingly, the ink supply unit 50 shown in FIG. 1 includes the shape conversion mechanism configured to perform the shape conversion of the ink supply tube Tw1, Tw2, so as to convert the bent portions where the precipitation of the ink is relatively more active into the bent portions where the precipitation of the ink is relatively less active. Such shape conversion performed by the shape conversion mechanism will be described hereunder. The shape conversion mechanism that performs the shape conversion of the ink supply tube Tw2 is substantially the same as the shape conversion mechanism that performs the shape conversion of the ink supply tube Tw1, and hence the same shape conversion method is applied to both of the ink supply tube Tw1 and the ink supply tube Tw2. Accordingly, solely the shape conversion of the ink supply tube Tw1 will be described hereunder.

Figure 3:
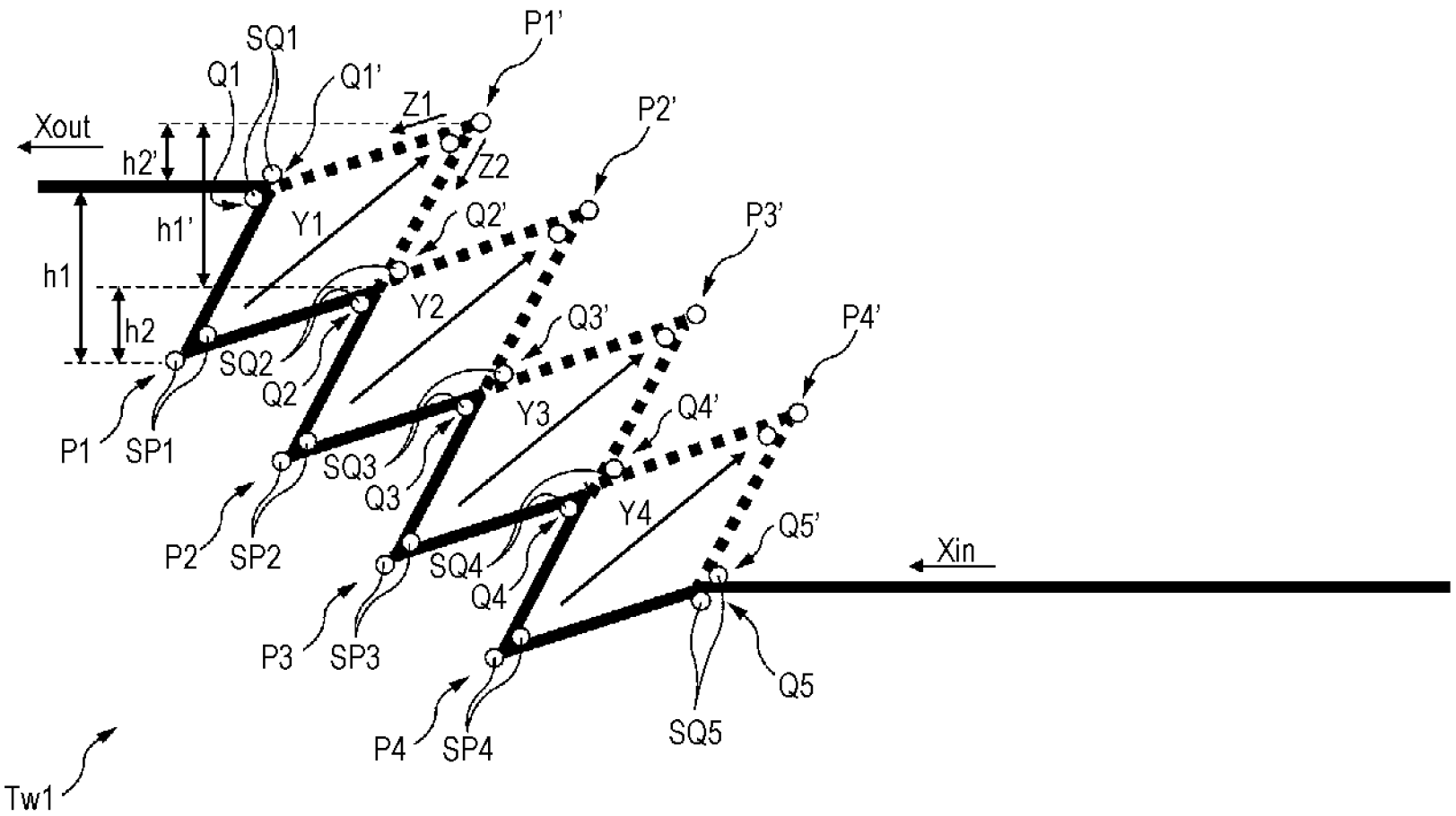
FIG. 3 is a schematic drawing of an ink supply tube before and after shape conversion.

FIG. 3 is a schematic drawing of the ink supply tube Tw1 before and after the shape conversion.

In the ink supply tube Tw1 shown in FIG. 3, the white ink that has flowed out of the ink cartridge of the white ink, in the ink cartridge chamber 51 of the upper stage in FIG. 2, proceeds as indicated by an arrow Xin through a horizontal section of the ink supply tube Tw1 on the right in FIG. 3, and passes through the zigzag portion of the ink supply path. Then the white ink proceeds as indicated by an arrow Xout through a horizontal section of the ink supply tube Tw1 on the left in FIG. 3, and reaches the relay tank 53 shown in FIG. 2.

The zigzag portion illustrated in solid lines in FIG. 3 represents the shape of the section with level difference in the ink supply tube Tw1 before the shape conversion, and the zigzag portion illustrated in broken lines in FIG. 3 represents the shape of the section with level difference in the ink supply tube Tw1 after the shape conversion.

In the ink supply tube Tw1 before the shape conversion, as shown in FIG. 3 the shape of the zigzag portion in solid lines is defined by four bent portions P1, P2, P3, P4 where a downward flow of the white ink is turned to an upward flow, a bent portion Q1 where the upward flow of the white ink is turned to a horizontal flow, three bent portions Q2, Q3, Q4 where the upward flow of the white ink is turned to the downward flow, and a bent portion Q5 where the horizontal flow of the white ink is turned to the downward flow, i.e., by nine bent portions in total. Hereafter, the bent portions where the downward flow of the white ink is turned to the upward flow will be referred to as "bent portion of first type", and the bent portions where the upward flow of the white ink is turned to the downward flow will be referred to as "bent portion of second type". Accordingly, the four bent portions P1, P2, P3, P4 where the downward flow of the white ink is turned to the upward flow are the bent portions of the first type. Here, it is preferable that the angle of the bent portions is wider than approximately 45 degrees, because a sharp corner of an excessively small angle affects the durability of the ink supply tube Tw and the fluidity of the ink.

To practically form the zigzag shape including the nine bent portions, the ink supply unit 50 shown in FIG. 1 includes nine support members SP1, SP2, SP3, SP4, SQ1, SQ2, SQ3, SQ4, SQ5 that respectively hold and support the nine bent portions P1, P2, P3, P4, Q1, Q2, Q3, Q4, Q5. The nine support members stably maintain the bent state of the zigzag shape.

Here, the nine bent portions P1, P2, P3, P4, Q1, Q2, Q3, Q4, Q5 exemplify the one or more bent portions in the present invention, and the nine support members SP1, SP2, SP3, SP4, SQ1, SQ2, SQ3, SQ4, SQ5 exemplify the one or more support members in the present invention. Further, out of the nine support members, the support members SQ1, SQ2, SQ3, SQ4, SQ5 other than the four support members SP1, SP2, SP3, SP4, respectively supporting the four bent portions of the first type P1, P2, P3, P4 in the ink supply tube Tw1 before the shape conversion, exemplify the first support member in the present invention. Likewise, the four support members SP1, SP2, SP3, SP4 respectively supporting the four bent portions of the first type P1, P2, P3, P4 exemplify the second support member in the present invention.

In the ink supply tube Tw1 before the shape conversion illustrated in solid lines in FIG. 3, each of the four bent portions of the first type P1, P2, P3, P4 is located at a position lower than two adjacent bent portions on the respective sides, in the vertical direction in FIG. 3. For example, the bent portion P1 at the left end of the four bent portions of the first type is at the position lower than the adjacent bent portion Q1 by a distance h1, and lower than the adjacent bent portion of the second type Q2 by a distance h2 in the vertical direction. Thus, since the four bent portions of the first type P1, P2, P3, P4 are at the positions lower than the two adjacent bent portions in the vertical direction in FIG. 3, the precipitation of the ink takes place more actively in the vicinity of the four bent portions of the first type P1, P2, P3, P4, than in other locations, for example the three bent portions Q2, Q3, Q4 where the upward flow of the white ink is turned to the downward flow.

Here, the ink supply unit 50 shown in FIG. 1 is capable of displacing, with the shape conversion mechanism to be subsequently described, the four support members SP1, SP2, SP3, SP4 respectively supporting the four bent portions of the first type P1, P2, P3, P4 in a direction indicated by arrows Y1, Y2, Y3, Y4 in FIG. 3, with the remaining five support members SQ1, SQ2, SQ3, SQ4, SQ5 respectively supporting the remaining bent portions Q1, Q2, Q3, Q4, Q5 fixed as they are. With such relative movement of the four support members SP1, SP2, SP3, SP4, the four bent portions of the first type P1, P2, P3, P4 supported by those support members are also displaced so as to change the shape of the ink supply tube Tw1, until the four bent portions of the first type P1, P2, P3, P4 are turned into new bent portions P1', P2', P3', P4' of the zigzag shape illustrated in broken lines. Here, the zigzag shape illustrated in broken lines includes, in addition to the new bent portions P1', P2', P3', P4', new bent portions Q1', Q2', Q3', Q4', Q5' located at the positions respectively coinciding with the positions of the bent portions Q1, Q2, Q3, Q4, Q5 before the shape conversion. Thus, the shape of the ink supply tube Tw1 after the shape conversion is defined by the totally nine bent portions P1', P2', P3', P4', Q1', Q2', Q3', Q4', Q5'.

In the ink supply tube Tw1 after the shape conversion, the bent portions P1', P2', P3', P4', respectively corresponding to the four bent portions of the first type P1, P2, P3, P4 before the shape conversion, are the bent portions of the second type where the upward flow of the white ink is turned to the downward flow. Each of the four bent portions of the second type P1', P2', P3', P4' is located at a position higher than the two adjacent bent portions in the vertical direction in FIG. 3. For example, the bent portion P1' at the left end of the four bent portions of the second type is at the position higher than the adjacent bent portion Q1' by a distance h2' (=h2), and higher than the adjacent bent portion Q2' by a distance h1' (=h1), in the vertical direction. Thus, since the four bent portions of the second type P1', P2', P3', P4' are at the positions higher than the two adjacent bent portions in the vertical direction in FIG. 3, the pigment component that precipitated in the white ink in each of the bent portions of the first type P1, P2, P3, P4 before the shape conversion starts to flow toward the two adjacent bent portions. For example, in the bent portion P1' at the left end of the four bent portions of the second type, the pigment component of the white ink flows in directions indicated by arrows Z1 and Z2 in FIG. 3, toward the adjacent bent portions Q1' and Q2' on the respective sides of the bent portion P1'.

Since the pigment component of the white ink thus starts to flow from each of the four bent portions of the second type P1', P2', P3', P4' toward the two adjacent bent portions, the white ink is actually stirred and therefore the density of the white ink becomes more homogeneous in the zigzag portion of the ink supply tube Tw1. Thus, the printer 1 provides improved homogeneity in density of the white ink, compared with the case where merely one or more bent portions are provided in the ink supply tube Tw1 and the shape conversion is not performed.

The shape conversion of the ink supply tube Tw1 described above is realized when the controller 60 shown in FIG. 1 controls the shape conversion mechanism (described later) so as to displace the four support members SP1, SP2, SP3, SP4. The controller 60 further controls the shape conversion mechanism, after performing the foregoing shape conversion, so as to perform reverse conversion including displacing the four support members SP1, SP2, SP3, SP4 in the reverse direction so as to restore the shape of the ink supply tube Tw1 illustrated in solid lines in FIG. 3. Such reverse conversion is performed for the following reason.

In the ink supply tube Tw1 after the first session of the shape conversion illustrated in broken lines in FIG. 3, the bent portions Q2', Q3', Q4' after the shape conversion, corresponding to the three bent portions of the second type Q2, Q3, Q4 before the shape conversion, are the bent portions of the first type where the downward flow of the white ink is turned to the upward flow. Accordingly, for the reason stated earlier, the precipitation of the ink becomes relatively more active in the bent portions of the first type Q2', Q3', Q4' of the ink supply tube Tw1 after the first session of the shape conversion. Through the reverse conversion, however, the bent portions of the first type Q2', Q3', Q4' are again turned into the bent portions of the second type Q2, Q3, Q4, and therefore the precipitation of the white ink in the bent portions of the first type Q2', Q3', Q4' can be avoided. Consequently, the homogeneity in density of the white ink in the ink supply tube Tw1 can be improved.

The controller 60 shown in FIG. 1 alternately performs the shape conversion and the reverse conversion of the ink supply tube Tw1 at predetermined time intervals. With such an arrangement the precipitation of the white ink in the bent portions of the first type disappears at the predetermined time intervals, and therefore the homogeneity in density of the white ink in the ink supply tube Tw1 can be further improved.

Here, the controller 60 shown in FIG. 1 corresponds to the control unit in the present invention.

The shape conversion mechanism will now be described in details hereunder.

Figure 4A:
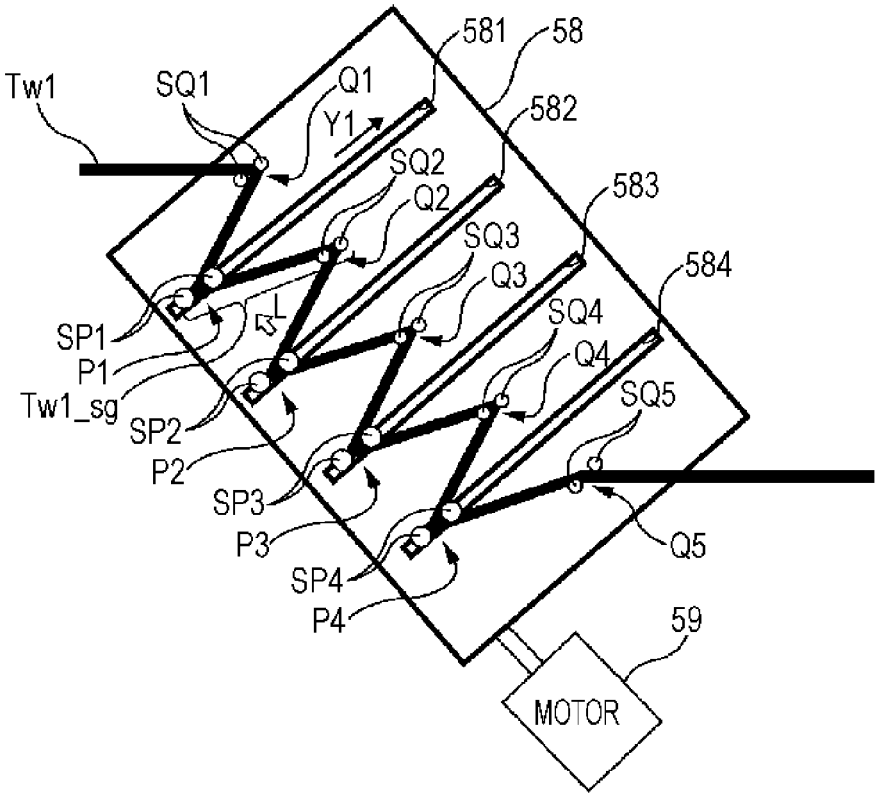
FIG. 4A is a schematic drawing showing the ink supply tube before the shape conversion, together with a part of a shape conversion mechanism.
Figure 4B:
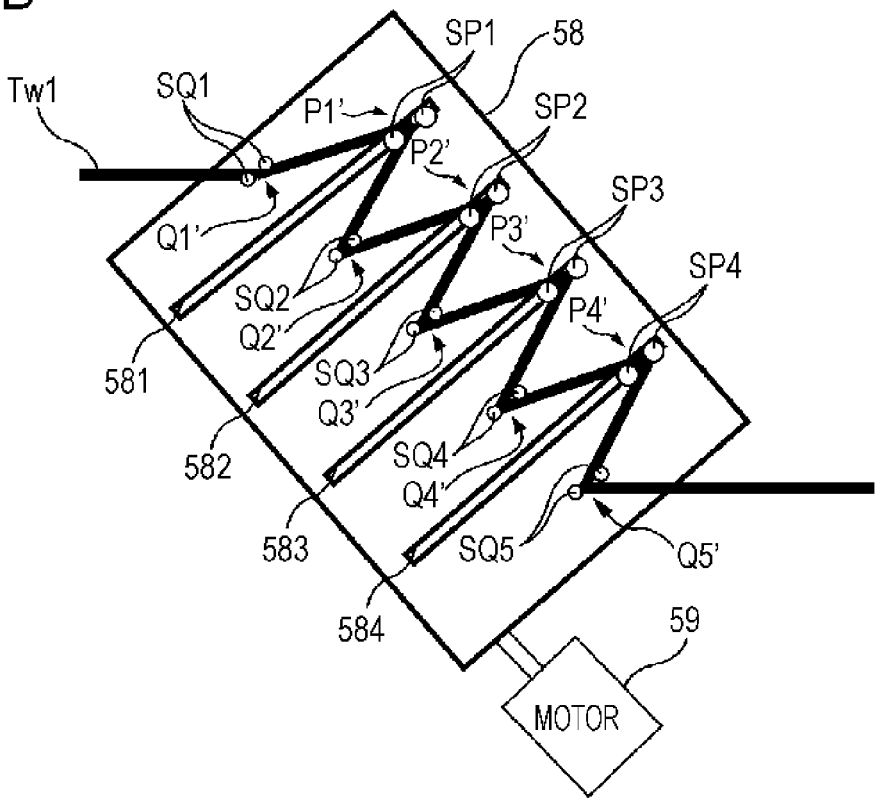
FIG. 4B is a schematic drawing showing the ink supply tube after the shape conversion, together with a part of the shape conversion mechanism.
Figure 5:
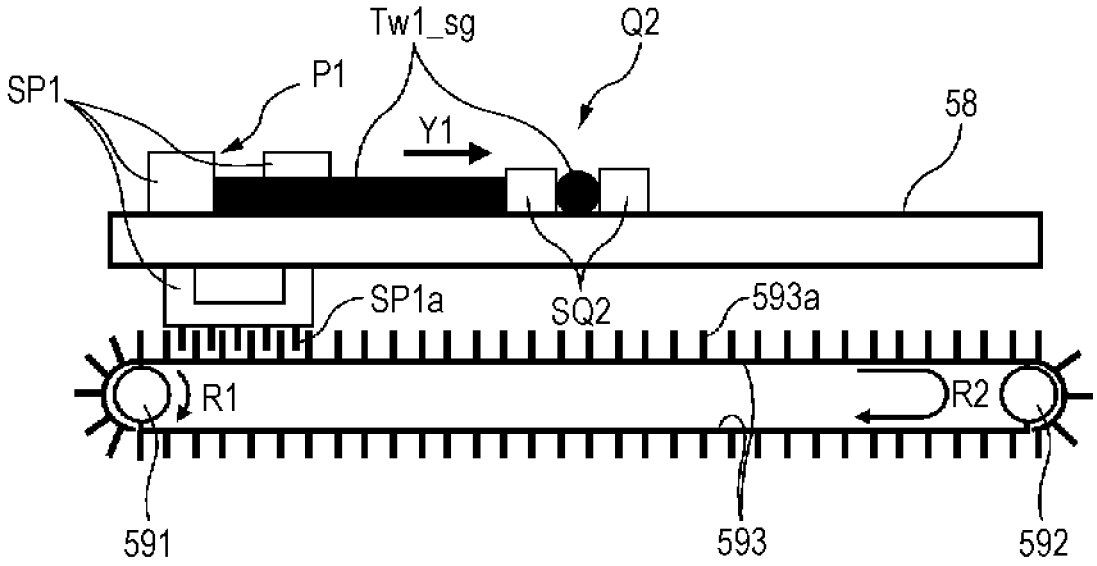
FIG. 5 is a schematic drawing for explaining how a support member is driven.

FIG. 4A is a schematic drawing showing the ink supply tube Tw1 before the shape conversion, together with a part of the shape conversion mechanism, FIG. 4B is a schematic drawing showing the ink supply tube Tw1 after the shape conversion, together with a part of the shape conversion mechanism, and FIG. 5 is a schematic drawing for explaining how the support member is driven.

The shape conversion mechanism includes a plate-shaped member 58 shown in FIGS. 4A, 4B, and 5, a motor 59 shown in FIGS. 4A and 4B, and a belt 593, a slave roller 592, and a driving roller 591 shown in FIG. 5.

As shown in FIG. 4A, the support members SQ1, SQ2, SQ3, SQ4, SQ5 out of the nine support members SP1, SP2, SP3, SP4, SQ1, SQ2, SQ3, SQ4, SQ5 shown in FIG. 3, other than the four support members SP1, SP2, SP3, SP4 that are to be displaced, i.e., the five support members respectively supporting the bent portions Q1, Q2, Q3, Q4, Q5 other than the bent portions of the first type P1, P2, P3, P4, out of the nine bent portions P1, P2, P3, P4, Q1, Q2, Q3, Q4, Q5 in the zigzag shape of the ink supply tube Tw1 illustrated in solid lines in FIG. 3, are fixed to a surface of the plate-shaped member 58. In addition, the plate-shaped member 58 includes four slits 581, 582, 583, 584 linearly extending in parallel to each other, and the four support members SP1, SP2, SP3, SP4 to be displaced have a portion thereof inserted in the respective slits 581, 582, 583, 584. In FIG. 4, the four support members SP1, SP2, SP3, SP4 are located at the left end portion of the four slits 581, 582, 583, 584, respectively. The ink supply tube Tw1 has the bent portions Q1, Q2, Q3, Q4, Q5 held by the support members SQ1, SQ2, SQ3, SQ4, SQ5 fixed to the surface of the plate-shaped member 58, and has the bent portions P1, P2, P3, P4 held by a portion of the support members SP1, SP2, SP3, SP4 sticking out from the respective slits 581, 582, 583, 584 toward the viewer in FIG. 4A, i.e., upward in FIG. 5. Thus, the ink supply tube Tw1 of the zigzag shape illustrated in solid lines in FIG. 3 is formed on the surface of the plate-shaped member 58. Here, the four support members SP1, SP2, SP3, SP4 respectively inserted in the four slits 581, 582, 583, 584 are subjected to a biasing force originating from the tension of the ink supply tube Tw1 and urging the four support members to move in the extending direction of the slits, for example indicated by the arrows Y1 to Y4 in FIG. 3. However, each of the support members SP1, SP2, SP3, SP4 abuts against the inner wall of the corresponding slit (inner wall on the respective sides extending along the slit), and the maximum static friction force between each of the support member and the inner wall of the corresponding slit is sufficiently larger than the tension of the ink supply tube Tw1. Therefore, the tension of the ink supply tube Tw1 alone is unable to displace any of the support members SP1, SP2, SP3, SP4 in the extending direction of the slits, and thus the four support members SP1, SP2, SP3, SP4 may be expressed as being caught by the respective slits and fixed thereto. However, when the driving force of the motor 59 that overcomes the maximum static friction force is exerted on each of the four support members SP1, SP2, SP3, SP4, the support members SP1, SP2, SP3, SP4 can each move inside the respective slits in the extending direction thereof. In other words, the plate-shaped member 58 supports each of the four support members SP1, SP2, SP3, SP4 with the slits respectively engaged with the support members, so as to allow the support members to move in the extending direction of the slits.

Referring now to FIG. 5, the mechanism that displaces the support members inserted in the corresponding slits will be described. To simplify the description, the case of displacing the support member SP1 supporting the bent portion of the first type P1 shown in FIG. 4A will be taken up.

FIG. 5 illustrates, out of the entirety of the ink supply tube Tw1, a section Tw1_sg extending between the bent portion of the first type P1 at the left end portion in FIG. 4A and the bent portion Q2 adjacent thereto on the right, together with a related portion of the plate-shaped member 58, viewed in a direction indicated by an arrow L in FIG. 4A.

As shown in FIG. 5, the support member SP1 supporting the bent portion of the first type P1 holds the left end portion of the section Tw1_sg (bent portion P1) of the ink supply tube Tw1, with the portion sticking out upward from the plate-shaped member 58, more precisely the portion sticking out from the slit 581 in which the support member SP1 is inserted as shown in FIG. 4A. The support member SQ2 fixed to the plate-shaped member 58 holds the right end portion of the section Tw1_sg (bent portion Q2) of the ink supply tube Tw1. The lower portion of the support member SP1 supporting the bent portion of the first type P1 sticks out downward from the plate-shaped member 58, more precisely the portion sticking out from the slit 581 in which the support member SP1 is inserted as shown in FIG. 4A. The lower portion of the support member SP1 sticking out downward from the plate-shaped member 58 includes a plurality of projections SP1*a*.

The belt 593 is provided under the lower portion of the support member SP1. The belt 593 is wound around the slave roller 592 and the driving roller 591 to be made to rotate by the rotational driving force of the motor 59 shown in FIG. 4A. The motor 59 shown in FIG. 4A is activated under the control of the controller 60 shown in FIG. 1. When the motor 59 shown in FIG. 4A rotates under the control of the controller 60 shown FIG. 1, so that the driving roller 591 is made to rotate, for example in a direction R1 in FIG. 5, by the rotational driving force of the motor 59, the belt 593 is caused to circulate in a direction R2 shown in FIG. 5. At this point, the slave roller 592 is made to rotate following up the circulating movement of the belt 593. Here, the belt 593 includes a plurality of projections 593*a* formed on the outer surface thereof. Each of the projections 593*a* is formed so as to be fitted in the space between the adjacently located projections SP1*a* on the lower portion of the support member SP1, thus to be meshed with the plurality of projections SP1*a*. Accordingly, when the belt 593 is made to run in the direction R2 in FIG. 5, the support member SP1 is displaced in the direction indicated by the arrow Y1 in FIG. 5 (same direction as the arrow Y1 in FIG. 4A and the extending direction of the slit 581) through inside the slit 581, following up the circulating movement of the belt 593. Since the rotational driving force of the motor 59 exerted on the support member SP1 via the belt 593 is larger than the maximum static friction force between the support member SP1 and the inner wall on the respective sides of the slit 581, the support member SP1 can be displaced inside the slit 581 overcoming the friction force with respect to the inner wall on the respective sides of the slit 581.

Mechanisms that are similar to the one that displaces the support member SP1 along the slit 581 as described above are also provided for the respective support members SP2, SP3, SP4 shown in FIG. 4A. When the four support members SP1, SP2, SP3, SP4 are thus displaced in the respective slits engaged therewith, the support members SP1, SP2, SP3, SP4 are also displaced so as to change the shape of the ink supply tube Tw1, and finally reach the right end portion of the slits in which those support members are respectively inserted, as shown in FIG. 4B. Accordingly, the four bent portions of the first type P1, P2, P3, P4 in the ink supply tube Tw1 before the shape conversion shown in FIG. 4A are converted to the four bent portions of the second type P1', P2', P3', P4' as shown in FIG. 4B, after the shape conversion. Then by the reverse conversion of the ink supply tube Tw1 performed under the control of the controller 60, the four bent portions of the second type P1', P2', P3', P4' are again converted to the original bent portions of the first type P1, P2, P3, P4. To perform the reverse conversion, the controller 60 causes the motor 59 in FIG. 4A in the direction opposite to the direction in the previous shape conversion, so as to cause the driving roller 591 to rotate opposite to the direction R1 shown in FIG. 5. Therefore, the support member SP1 is displaced through inside the slit 581 in the direction opposite to the arrow Y1 shown in FIG. 4A. The same reverse conversion is performed at the same time with respect to the remaining support members SP2, SP3, SP4, so as to displace those support members in the direction opposite to the movement in the previous shape conversion.

The shape conversion mechanism described above, which includes the plate-shaped member 58 shown in FIGS. 4A, 4B, and 5, the motor 59 shown in FIGS. 4A and 4B, and the belt 593, the slave roller 592, and the driving roller 591 shown in FIG. 5, corresponds to the bent shape conversion unit in the present invention. Further, the plate-shaped member 58 corresponds to the plate-shaped member in the liquid dispensing apparatus according to the first application example, and the set composed of the motor 59, the belt 593, the slave roller 592, and the driving roller 591 corresponds to the driving unit in the liquid dispensing apparatus according to the first application example.

The shape conversion mechanism for the ink supply tube Tw1 is configured as described above. As stated earlier, another shape conversion mechanism configured in the same way as above is provided for the ink supply tube Tw2 shown in FIG. 2, and the same shape conversion process as that for the ink supply tube Tw1 is performed with respect to the ink supply tube Tw2, under the control of the controller 60.

As described thus far, the configuration according to the first embodiment allows the shape conversion of the ink supply path to be easily performed, with a simple mechanism configured to merely displace along the slits the support members inserted in the respective slits.

Second Embodiment

A liquid dispensing apparatus according to a second embodiment of the present invention will now be described. The second embodiment corresponds to the second application example cited above.

The liquid dispensing apparatus according to the second embodiment is also exemplified by an ink jet printer, as in the first embodiment. The printer according to the second embodiment is different from the printer 1 of the first embodiment in the configuration of the shape conversion mechanism for the ink supply tube included in the ink supply unit, compared with the shape conversion mechanism for the ink supply tube according to the first embodiment shown in FIGS. 4A, 4B, and 5. Except for such an aspect, the printer according to the second embodiment has the same configuration and performs the same operation, as those of the printer 1 according to the first embodiment. For example, in the printer according to the second embodiment also, the shape conversion and the reverse conversion of the ink supply tube described above referring to FIG. 3 are performed at predetermined time intervals, under the control of a controller 60. In the description given hereunder, the description of the configurations and operations that are the same as those of the first embodiment will not be repeated, and the shape conversion mechanism, which constitutes the difference, will be focused on. Accordingly, the same constituents as those of the first embodiment will be given the same numeral, and the description thereof will not be repeated.

Figure 6A:
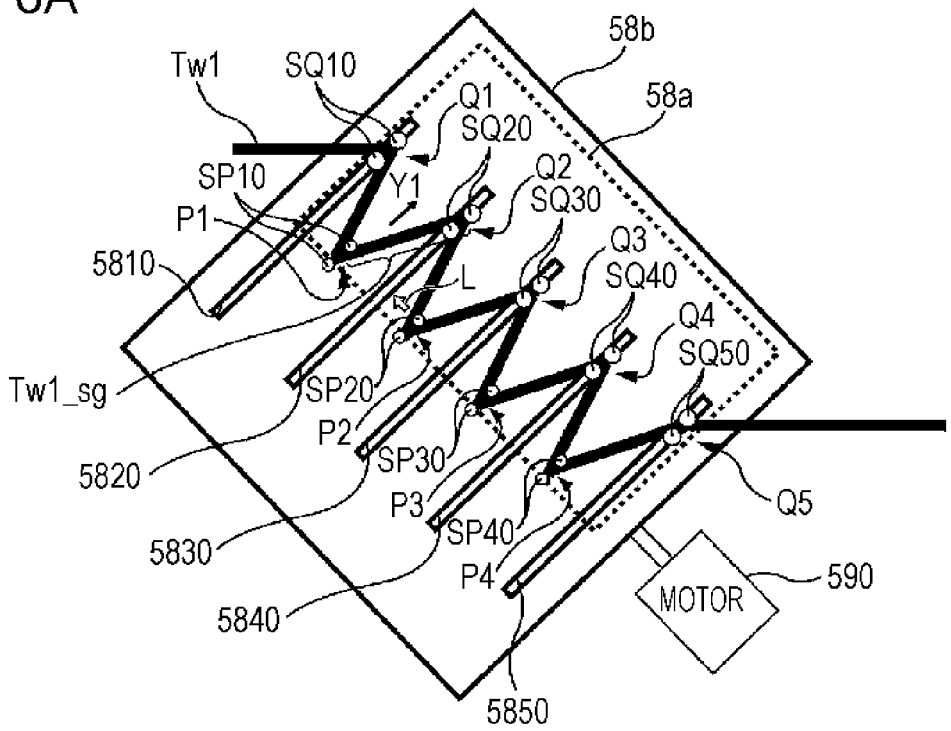
FIG. 6A is a schematic drawing showing the ink supply tube before the shape conversion, together with a part of a shape conversion mechanism according to a second embodiment of the present invention.
Figure 6B:
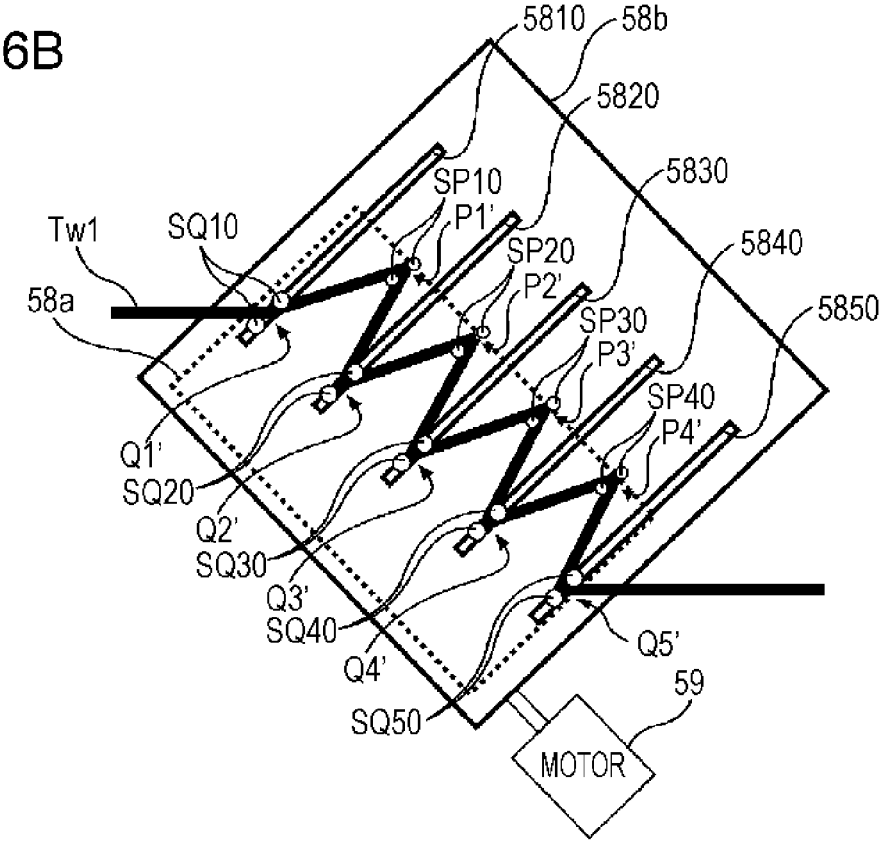
FIG. 6B is a schematic drawing showing the ink supply tube after the shape conversion, together with a part of the shape conversion mechanism according to the second embodiment.
Figure 7:
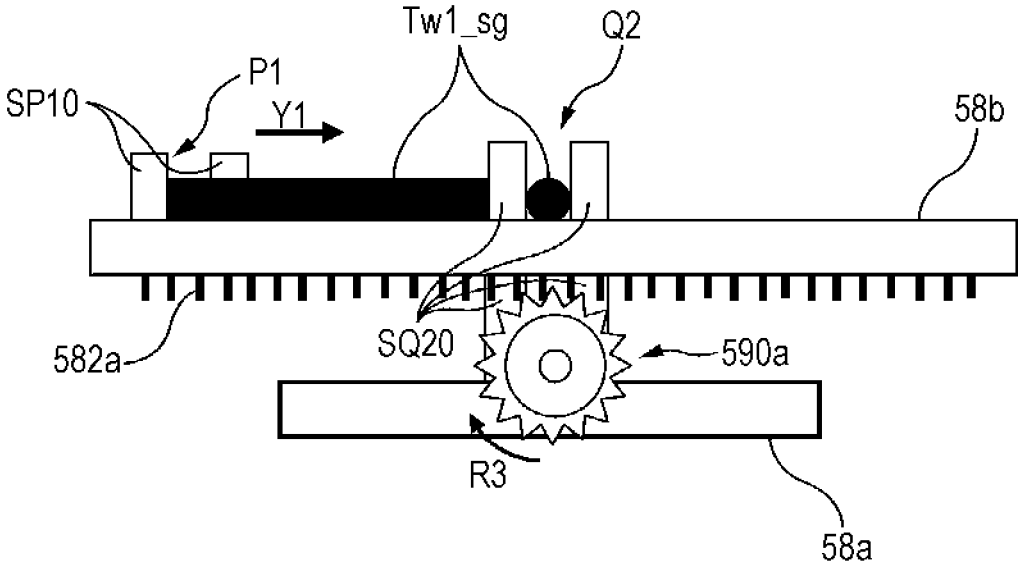
FIG. 7 is another schematic drawing for explaining how a support member is driven.

FIG. 6A is a schematic drawing showing the ink supply tube Tw1 before the shape conversion, together with a part of the shape conversion mechanism according to the second embodiment, FIG. 6B is a schematic drawing showing the ink supply tube after the shape conversion, together with a part of the shape conversion mechanism according to the second embodiment, and FIG. 7 is a schematic drawing for explaining how the support member is driven.

The shape conversion mechanism according to the second embodiment includes a first plate-shaped member 58*a* and a second plate-shaped member 58*b* shown in FIGS. 6A, 6B, and 7, a motor 590 shown in FIGS. 6A and 6B, and a gear 590*a* shown in FIG. 7. As shown in FIG. 7, the first plate-shaped member 58*a* is located under the second plate-shaped member 58*b* in FIG. 7. In FIGS. 6A and 6B, the first plate-shaped member 58*a* hidden below the second plate-shaped member 58*b* and hence unseen is illustrated in broken lines.

In the second embodiment, as shown in FIG. 6A, nine support members SP10, SP20, SP30, SP40, SQ10, SQ20, SQ30, SQ40, SQ50 respectively supporting the nine bent portions P1, P2, P3, P4, Q1, Q2, Q3, Q4, Q5 of the ink supply tube Tw1 (see FIG. 3) are provided. Out of the nine support members, four support members SP10, SP20, SP30, SP40 respectively supporting the bent portions of the first type P1, P2, P3, P4 are fixed to a surface of the second plate-shaped member 58*b*. The second plate-shaped member 58*b* includes five slits 5810, 5820, 5830, 5840, 5850 linearly extending in parallel to each other, and five support members SQ10, SQ20, SQ30, SQ40, SQ50 out of the nine support members, respectively supporting the bent portions Q1, Q2, Q3, Q4, Q5 other than the bent portions of the first type P1, P2, P3, P4, have a portion thereof inserted in the five slits 5810, 5820, 5830, 5840, 5850, respectively. In FIG. 6A, the five support members SQ10, SQ20, SQ30, SQ40, SQ50 are respectively located at the right end portion of the five slits 5810, 5820, 5830, 5840, 5850. The ink supply tube Tw1 has the bent portions P1, P2, P3, P4 held by the support members SP10, SP20, SP30, SP40 fixed to the surface of the second plate-shaped member 58*b*, and has the bent portions Q1, Q2, Q3, Q4, Q5 held by a portion of the support members SQ10, SQ20, SQ30, SQ40, SQ50 sticking out from the respective slits 5810, 5820, 5830, 5840, 5850 toward the viewer in FIG. 6A, i.e., upward in FIG. 7. Thus, the ink supply tube Tw1 of the zigzag shape illustrated in solid lines in FIG. 3 is formed on the surface of the second plate-shaped member 58*b*. The five support members SQ10, SQ20, SQ30, SQ40, SQ50 also stick out from the opposite side of the respective slits, and the end portion of the projecting portion is fixed to the first plate-shaped member 58*a*.

The second plate-shaped member 58*b* is movable in the extending direction of the five slits with the mechanism described below. The first plate-shaped member 58*a* is fixed to the non-illustrated casing of the ink jet printer according to the second embodiment, and hence unable to move. Accordingly, when the second plate-shaped member 58*b* moves with respect to the first plate-shaped member 58*a*, the four support members SP10, SP20, SP30, SP40 fixed to the surface of the second plate-shaped member 58*b* move together with the second plate-shaped member 58*b*, and the five slits 5810, 5820, 5830, 5840, 5850 also move together with the second plate-shaped member 58*b*, with the five support members SQ10, SQ20, SQ30, SQ40, SQ50 respectively maintained therein. Therefore, the four support members SP10, SP20, SP30, SP40 are relatively displaced with respect to the five support members SQ10, SQ20, SQ30, SQ40, SQ50.

Referring to FIG. 7, the mechanism that moves the second plate-shaped member 58*b* to thereby displace the four support members SP10, SP20, SP30, SP40 fixed to the second plate-shaped member 58*b* will be described. To simplify the description, the case of displacing the support member SP10 supporting the bent portion of the first type P1 shown at the left end portion in FIG. 6A will be taken up.

FIG. 7 illustrates, out of the entirety of the ink supply tube Tw1, the section Tw1_sg extending between the bent portion of the first type P1 at the left end portion in FIG. 6A and the bent portion Q2 adjacent thereto on the right, together with the first plate-shaped member 58*a* and the second plate-shaped member 58*b*, viewed in a direction indicated by an arrow L in FIG. 6A.

As shown in FIG. 7, the support member SP10 fixed to the second plate-shaped member 58*b* and supporting the bent portion of the first type P1 holds the left end portion of the section Tw1_sg (bent portion P1) of the ink supply tube Tw1. The support member SQ20 inserted in the slit 5820 shown in FIG. 6A and fixed to the first plate-shaped member 58*a* (though the joint portion is hidden behind a gear 590*a* to be described later in FIG. 7, the lower end portion sticking out downward is fixed to the first plate-shaped member 58*a* as mentioned above) holds the right end portion of the section Tw1_sg (bent portion Q2) of the ink supply tube Tw1. The second plate-shaped member 58*b* includes a plurality of projections 582*a* formed on the lower face thereof.

A gear 590*a* to be made to rotate by the rotational driving force of the motor 590 shown in FIG. 6A and the first plate-shaped member 58*a* are provided under the second plate-shaped member 58*b*. As shown in FIG. 7, the teeth of the gear 590*a* are meshed with the projections 582*a* on the lower face of the second plate-shaped member 58*b*. The motor 590 is activated under the control of the controller 60 shown in FIG. 1. When the motor 590 shown in FIG. 6A rotates under the control of the controller 60, so that the gear 590*a* is made to rotate, for example in a direction R3 in FIG. 7, by the rotational driving force of the motor 590, the second plate-shaped member 58*b* is caused to move in a direction indicated by the arrow Y1 in FIG. 7 (same direction as the arrow Y1 in FIG. 6A and the extending direction of the slit 5820) following up the rotation of the gear 590*a* in the direction R3. With such movement of the second plate-shaped member 58*b*, the support member SP10 fixed to the second plate-shaped member 58*b* is also displaced in the direction indicated by the arrow Y1 in FIG. 7 (arrow Y1 in FIG. 6A). Since the support member SQ20 fixed to the first plate-shaped member 58*a* shown in FIG. 7 remains unmoved during the movement of the second plate-shaped member 58*b*, the support member SP10 fixed to the second plate-shaped member 58*b* moves in the direction indicated by the arrow Y1 in FIG. 7, with respect to the support member SQ20 fixed to the first plate-shaped member 58*a*.

When the second plate-shaped member 58*b* is caused to move, the slit 5820 shown in FIG. 6A in which the support member SP10 shown in FIG. 7 also moves in the direction indicated by the arrows Y1 in FIGS. 6A and 7. Therefore, relatively, the support member SQ20 fixed to the first plate-shaped member 58*a* moves in the direction opposite to the arrow Y1, inside the slit 5820.

The support member SP10 fixed to the second plate-shaped member 58*b* and the slit 5820 are thus displaced with respect to the support member SQ20 fixed to the first plate-shaped member 58*a*. In addition, naturally, the remaining support members SP2, SP3, SP4 fixed to the second plate-shaped member 58*b* and the remaining slits 5810, 5830, 5840, 5850 are also displaced at the same time, when the second plate-shaped member 58*b* is caused to move. When the four support members SP10, SP20, SP30, SP40 fixed to the second plate-shaped member 58*b* and the five slits 5810, 5820, 5830, 5840, 5850 are thus displaced, the shape of the ink supply tube Tw1 is gradually changed, and finally the support members SQ10, SQ20, SQ30, SQ40, SQ50 fixed to the first plate-shaped member 58*a* reach the left end portion of the slits in which those support members are respectively inserted, as shown in FIG. 6B. Accordingly, the four bent portions of the first type P1, P2, P3, P4 in the ink supply tube Tw1 before the shape conversion shown in FIG. 6A are converted to the four bent portions of the second type P1', P2', P3', P4' as shown in FIG. 6B, after the shape conversion. Then by the reverse conversion of the ink supply tube Tw1 performed under the control of the controller 60, the four bent portions of the second type P1', P2', P3', P4' are again converted to the original bent portions of the first type P1, P2, P3, P4. To perform the reverse conversion, the controller 60 causes the motor 590 shown in FIG. 6A in the direction opposite to the direction in the previous shape conversion, so as to cause the gear 590*a* to rotate opposite to the direction R3 shown in FIG. 7. Therefore, the support member SP10 fixed to the second plate-shaped member 58*b* and the slit 5820 shown in FIG. 6B are displaced in the direction opposite to the arrow Y1 in FIG. 6A. At the same time, the remaining support members SP20, SP30, SP40 and the remaining slits 5810, 5830, 5840, 5850 are also displaced in the direction opposite to the movement in the previous shape conversion.

The shape conversion mechanism described above, which includes the first plate-shaped member 58*a* and the second plate-shaped member 58*b* shown in FIGS. 6A, 6B, and 7, the motor 590 shown in FIGS. 6A and 6B, and the gear 590*a* shown in FIG. 7, corresponds to the bent shape conversion unit in the present invention. Further, the first plate-shaped member 58*a* and the second plate-shaped member 58*b* respectively correspond to the first plate-shaped member and the second plate-shaped member in the liquid dispensing apparatus according to the second application example, and the set of the motor 590 and the gear 590*a* corresponds to the driving unit in the liquid dispensing apparatus according to the second application example.

The shape conversion mechanism for the ink supply tube Tw1 is configured as described above. As stated earlier, another shape conversion mechanism configured in the same way as above is provided for the ink supply tube Tw2 (see FIG. 2), and the same shape conversion process as that for the ink supply tube Tw1 is performed with respect to the ink supply tube Tw2, under the control of the controller 60.

As described thus far, the configuration according to the second embodiment allows the shape conversion of the ink supply path to be easily performed, with a simple mechanism configured to merely displace both of the second plate-shaped member 58*b* including the slits and the support members fixed to the second plate-shaped member 58*b* in the extending direction of the slits, with respect to the fixed support members inserted in the respective slits.

Third Embodiment

A liquid dispensing apparatus according to a third embodiment of the present invention will now be described. The third embodiment corresponds to the third application example cited above.

The liquid dispensing apparatus according to the third embodiment is also exemplified by an ink jet printer, as in the first embodiment. The printer according to the third embodiment is different from the printer 1 of the first embodiment in the configuration of the shape conversion mechanism for the ink supply tube included in the ink supply unit, compared with the shape conversion mechanism for the ink supply tube according to the first embodiment shown in FIGS. 4A, 4B, and 5. Except for such an aspect, the printer according to the third embodiment has the same configuration and performs the same operation, as those of the printer 1 according to the first embodiment. For example, in the printer according to the third embodiment also, the shape conversion and the reverse conversion of the ink supply tube described above referring to FIG. 3 are performed at predetermined time intervals, under the control of a controller 60. In the description given hereunder, the description of the configurations and operations that are the same as those of the first embodiment will not be repeated, and the shape conversion mechanism, which constitutes the difference, will be focused on. Accordingly, the same constituents as those of the first embodiment will be given the same numeral, and the description thereof will not be repeated.

Figure 8A:
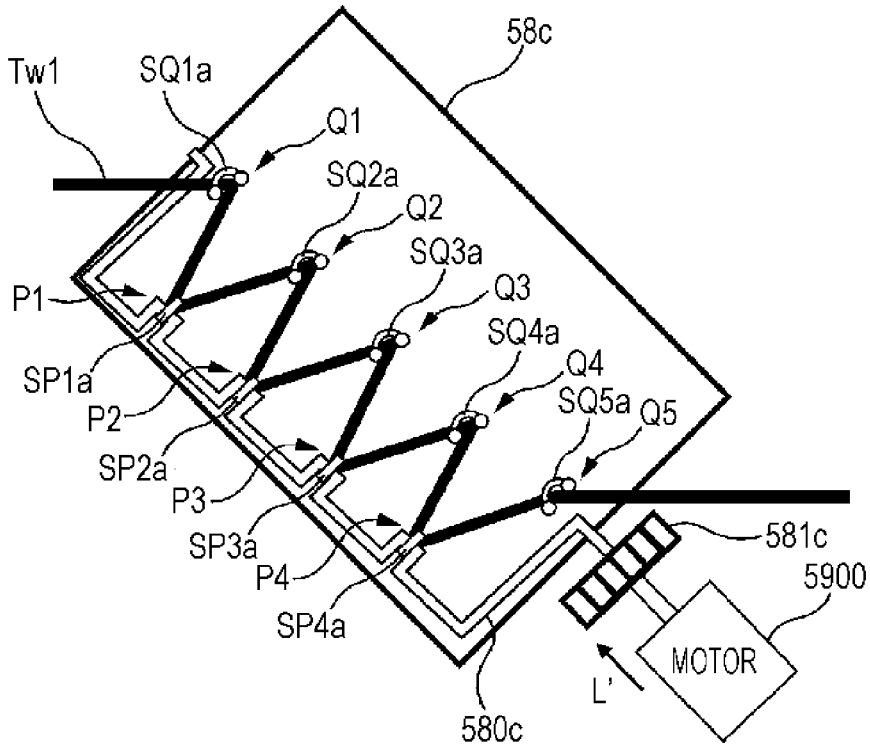
FIG. 8A is a schematic drawing showing the ink supply tube before the shape conversion, together with a part of a shape conversion mechanism according to a third embodiment of the present invention.
Figure 8B:
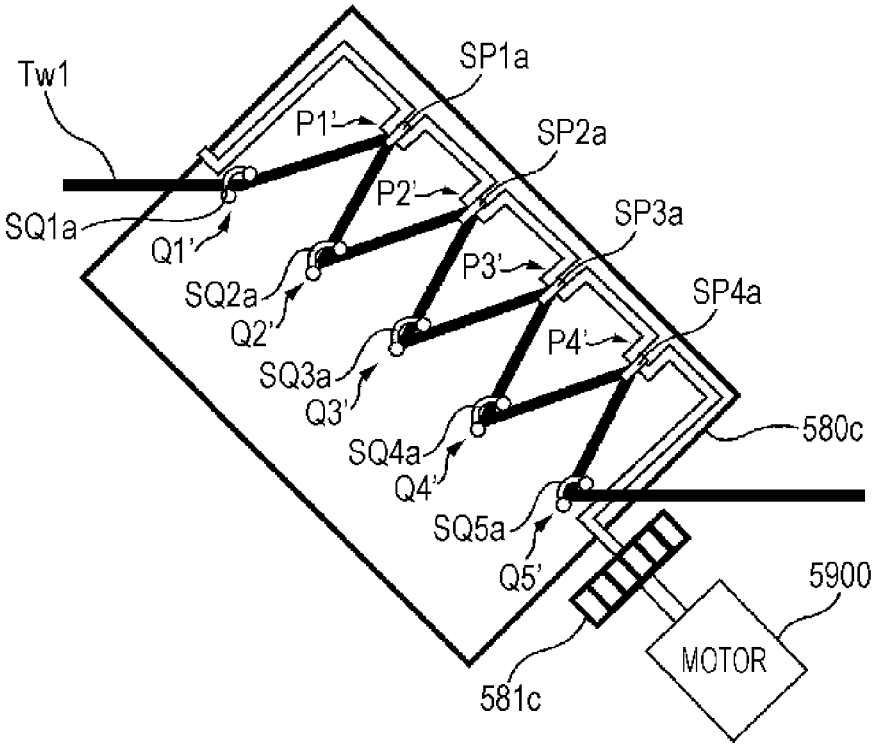
FIG. 8B is a schematic drawing showing the ink supply tube after the shape conversion, together with a part of the shape conversion mechanism according to the third embodiment.
Figure 9:
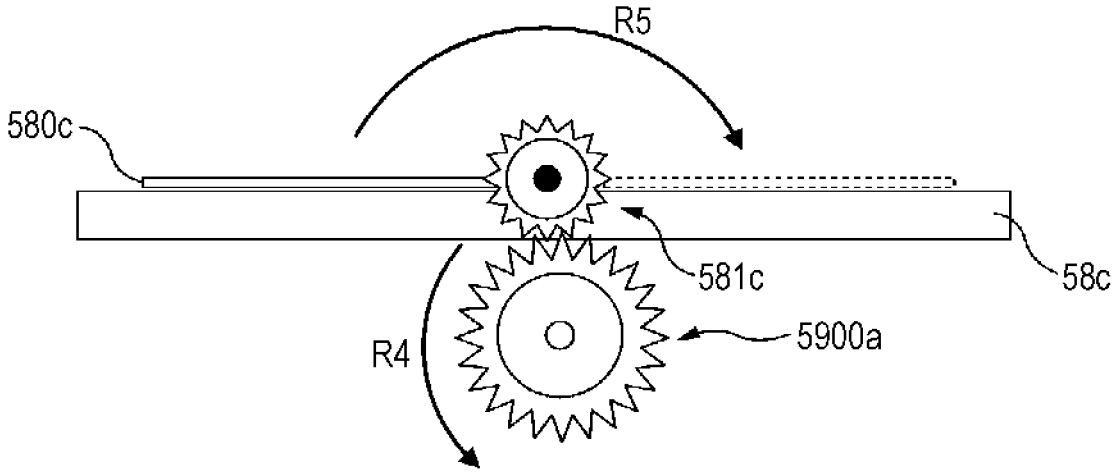
FIG. 9 is still another schematic drawing for explaining how a support member is driven.

FIG. 8A is a schematic drawing showing the ink supply tube Tw1 before the shape conversion, together with a part of the shape conversion mechanism according to the third embodiment, and FIG. 8B is a schematic drawing showing the ink supply tube Tw1 after the shape conversion, together with a part of the shape conversion mechanism according to the third embodiment. FIG. 9 is a schematic drawing for explaining how the support member is driven.

The shape conversion mechanism according to the third embodiment includes a base plate member 58*c*, a pivotal frame member 580*c*, and a first gear 581*c* shown in FIGS. 8A, 8B, and 9, a motor 5900 shown in FIGS. 8A and 8B, and a second gear 5900*a* shown in FIG. 9.

In the third embodiment, as shown in FIG. 8A, nine support members SP1*a*, SP2*a*, SP3*a*, SP4*a*, SQ1*a*, SQ2*a*, SQ3*a*, SQ4*a*, SQ5*a* respectively supporting the nine bent portions P1, P2, P3, P4, Q1, Q2, Q3, Q4, Q5 of the ink supply tube Tw1 (see FIG. 3) are provided. Out of the nine support members, four support members SP1*a*, SP2*a*, SP3*a*, SP4*a* respectively supporting the bent portions of the first type P1, P2, P3, P4 are fixed to the pivotal frame member 580*c*. The remaining five support members SQ1*a*, SQ2*a*, SQ3*a*, SQ4*a*, SQ5*a* out of the nine support members, respectively supporting the bent portions Q1, Q2, Q3, Q4, Q5 other than the bent portions of the first type P1, P2, P3, P4, are fixed to the base plate member 58*c*. The positions on the base plate member 58*c* where the five support members SQ1*a*, SQ2*a*, SQ3*a*, SQ4*a*, SQ5*a* are respectively fixed are linearly aligned on the base plate member 58*c*, as shown in FIG. 8A. The line connecting those positions coincides with the axial center of the first gear 581*c*. The ink supply tube Tw1 has the four bent portions P1, P2, P3, P4 respectively hooked with the support members SP1*a*, SP2*a*, SP3*a*, SP4*a* fixed to the pivotal frame member 580*c*, thus to be supported by the pivotal frame member 580*c*, and has the five bent portions Q1, Q2, Q3, Q4, Q5 respectively hooked with the support member SQ1*a*, SQ2*a*, SQ3*a*, SQ4*a*, SQ5*a* fixed to the base plate member 58*c*, thus to be supported by the base plate member 58*c*. Thus, the ink supply tube Tw1 of the zigzag shape illustrated in solid lines in FIG. 3 is formed on the surface of the base plate member 58*c*.

The pivotal frame member 580*c* has a bent two-dimensional shape, and an end portion is connected to the shaft of the first gear 581*c*. The pivotal frame member 580*c* is given the rotational driving force of the motor 5900 through the first gear 581*c*, so as to pivot with respect to the base plate member 58*c* which is immobile, about a pivotal axis coinciding with a line passing the axial center of the first gear 581*c* and the five positions where the support members SQ1*a*, SQ2*a*, SQ3*a*, SQ4*a*, SQ5*a* are fixed to the base plate member 58*c*. With such a pivoting motion, the four support members SP1*a*, SP2*a*, SP3*a*, SP4*a* fixed to the pivotal frame member 580*c* are also made to pivot together with the pivotal frame member 580*c*. In contrast, the five support members SQ1*a*, SQ2*a*, SQ3*a*, SQ4*a*, SQ5*a* fixed to the base plate member 58*c* are located on the pivotal axis, and hence not displaced by the pivoting motion of the pivotal frame member 580*c*. Accordingly, the four support members SP1*a*, SP2*a*, SP3*a*, SP4*a* are made to relatively pivot with respect to the five support members SQ1*a*, SQ2*a*, SQ3*a*, SQ4*a*, SQ5*a*. Here, because of the presence of the base plate member 58*c*, the pivotal frame member 580*c* can only pivot from the position on the left of the pivotal axis as shown in FIG. 8A until contacting the base plate member 58*c* at the position on the right of the pivotal axis as shown in FIG. 8B. In other words, the pivotal frame member 580*c* can be made to pivot in a range of 180 degrees between the position shown in FIG. 8A and the position shown in FIG. 8B.

Referring to FIG. 9, a mechanism that causes the pivotal frame member 580*c* to pivot so as to displace the four support members SP1*a*, SP2*a*, SP3*a*, SP4*a* fixed to the pivotal frame member 580*c* will be described hereunder.

FIG. 9 illustrates the pivotal frame member 580*c* and the base plate member 58*c* viewed in a direction indicated by an arrow L' in FIG. 8A. The position of the pivotal frame member 580*c* illustrated in a solid line in FIG. 9 correspond to the position shown in FIG. 8A, and the position of the pivotal frame member 580*c* illustrated in a broken line corresponds to the position shown in FIG. 8B. In FIG. 9, the zigzag portion of the ink supply tube Tw1 is hidden behind the pivotal frame member 580*c* when viewed in the direction of the arrow L' in FIG. 8A, and hence not illustrated, and the remaining portion of the ink supply tube Tw1 is not illustrated either, for the sake of clarity. However, since the pivoting of the zigzag portion of the ink supply tube Tw1 is unified with the pivoting motion of the pivotal frame member 580*c* as stated above, the mechanism that causes the pivotal frame member 580*c* to pivot serves, as it is, as the shape conversion mechanism for the zigzag portion of the ink supply tube Tw1.

As shown in FIG. 9, the second gear 5900*a* is provided under the first gear 581*c* to which the pivotal frame member 580*c* is connected. The shaft of the second gear 5900*a* is directly connected to the shaft of the motor 5900 shown in FIG. 8A. The teeth of the second gear 5900*a* are meshed with the teeth of the first gear 581*c*, and therefore when the second gear 5900*a* is made to rotate by the rotational driving force of the motor 5900, for example in a direction indicated by an arrow R4 in FIG. 9, the first gear 581*c* is made to rotate in a direction indicated by an arrow R5 in FIG. 9, following up the rotation of the second gear 5900*a*. With such rotation of the first gear 581*c*, pivotal the frame member 580*c* connected to the first gear 581*c* is caused to pivot in the direction of the arrow R5, from the position on the left of the first gear 581*c* illustrated in the solid line. Then the pivotal the frame member 580*c* abuts against the base plate member 58*c* thus to be located on the right of the first gear 581*c* as illustrated in the broken line.

With such a pivoting motion of the pivotal frame member 580*c*, the four support members SP1*a*, SP2*a*, SP3*a*, SP4*a* (see FIG. 8A) fixed to the pivotal frame member 580*c* are also made pivot, thereby changing the shape of the ink supply tube Tw1. Finally, the four support members SP1*a*, SP2*a*, SP3*a*, SP4*a* reach the position opposite to FIG. 8A with respect to the pivotal axis passing the positions where the five support members SQ1*a*, SQ2*a*, SQ3*a*, SQ4*a*, SQ5*a* are fixed to the base plate member 58*c*, as shown in FIG. 8B. Accordingly, the four bent portions of the first type P1, P2, P3, P4 in the ink supply tube Tw1 before the shape conversion shown in FIG. 8A are converted to the four bent portions of the second type P1', P2', P3', P4' as shown in FIG. 8B, after the shape conversion. Then by the reverse conversion of the ink supply tube Tw1 performed under the control of the controller 60, the four bent portions of the second type P1', P2', P3', P4' are again converted to the original bent portions of the first type P1, P2, P3, P4. To perform the reverse conversion, the controller 60 causes the motor 5900 shown in FIG. 8A in the direction opposite to the direction in the previous shape conversion, so as to cause the first gear 581*c* and the second gear 5900*a* to rotate opposite to the respective directions R4 and R5 shown in FIG. 9. Therefore, the four support members SP1*a*, SP2*a*, SP3*a*, SP4*a* (see FIG. 8A) fixed to the pivotal frame member 580*c* are caused to pivot in the direction opposite to R5 in FIG. 9.

The shape conversion mechanism described above, which includes the base plate member 58*c*, the pivotal frame member 580*c*, and the first gear 581*c* shown in FIGS. 8A, 8B, and 9, the motor 5900 shown in FIGS. 8A and 8B, and the second gear 5900*a* shown in FIG. 9, corresponds to the bent shape conversion unit in the present invention. Further, the base plate member 58*c* corresponds to the plate-shaped member in the liquid dispensing apparatus according to the third application example, and the pivotal frame member 580*c* corresponds to the frame member in the liquid dispensing apparatus according to the third application example. In addition, the set composed of the motor 5900, the first gear 581*c*, and the second gear 5900*a* corresponds to the driving unit in the liquid dispensing apparatus according to the third application example.

The shape conversion mechanism for the ink supply tube Tw1 is configured as described above. Another shape conversion mechanism configured in the same way as above is provided for the ink supply tube Tw2 (see FIG. 2), and the same shape conversion process as that for the ink supply tube Tw1 is performed with respect to the ink supply tube Tw2, under the control of the controller 60.

As described thus far, the configuration according to the third embodiment allows the shape conversion of the ink supply path to be easily performed, with a simple mechanism configured to merely displace both of the pivotal frame member 580*c* and the support members fixed to the pivotal frame member 580*c* at a time.

Other Embodiments

Although the sedimentary ink is exemplified by the white ink in the foregoing embodiments, the present invention is also applicable to different types of sedimentary ink.

Although the liquid dispensing apparatus is exemplified by the ink jet printer in the foregoing embodiments, the present invention is also applicable to apparatuses that eject or dispense a fluid other than ink, such as a liquid in which particles of a functional material are dispersed and a gel-form fluid. Further, the techniques similar to those of the foregoing embodiments may be applied to apparatuses that employ the ink jet technology, such as color filter manufacturing equipment, a dyeing machine, a micromachining apparatus, semiconductor manufacturing equipment, a surface processing machine, a 3D prototyping machine, a gasification machine, organic EL manufacturing equipment (particularly, polymer EL manufacturing equipment), display manufacturing equipment, film deposition apparatus, and DNA chip manufacturing equipment. Still further, the dispensing methods adopted in those apparatuses and the manufacturing methods thereof are also included in the scope of the present invention.

The foregoing embodiments are intended for facilitating the understanding of the present invention, and in no way for limiting the interpretation of the present invention. Various modifications or improvements may be made without departing from the scope and spirit of the present invention, and it is a matter of course that the equivalents are also included in the present invention.

The entire disclosure of Japanese Patent Application No. 2013-058444, filed Mar. 21, 2013 is expressly incorporated by reference herein.

What is claimed is:

1. A liquid dispensing apparatus comprising:

a head that dispenses a liquid containing a sedimentary substance;

a liquid tank for storing the liquid;

a liquid supply path through which the liquid is supplied from the ink tank to the head via a section having a level difference larger than a predetermined distance in a vertical direction, the section with the level difference including one or more bent portions including a bent portion of a first type where a downward flow of the liquid is turned to an upward flow;

a bent shape conversion unit configured to change a shape of the liquid supply path with respect to the section with the level difference, so as to convert the bent portion of the first type in the section with the level difference before the shape conversion, into a bent portion of a second type where an upward flow of the liquid is turned to a downward flow; and a control unit configured to cause the bent shape conversion unit to perform the shape conversion and restore the initial shape of the liquid supply path by reverse conversion of the shape of the liquid supply path after the shape conversion.

2. The liquid dispensing apparatus according to claim 1, wherein the liquid supply path is formed of a flexible tube and allows the liquid to pass through inside the tube to thereby supply the liquid from the liquid tank to the head, and further includes one or more support members that respectively support the one or more bent portions to thereby determine the shape of the section with the level difference of the liquid supply path.

3. The liquid dispensing apparatus according to claim 2, wherein the bent shape conversion unit is configured to convert the shape by moving, out of the one or more support members, a second support member supporting the bent portion of the first type, relatively with respect to a first support member supporting the bent portion other than the bent portion of the first type, out of the one or more support members.

4. The liquid dispensing apparatus according to claim 3, wherein the bent shape conversion unit includes:

a plate-shaped member having the first support member fixed to a surface thereof and including a slit linearly extending so as to allow the second support member to be inserted, the plate-shaped member supporting the second support member inserted in the slit, so as to allow the second support member to linearly move in the extending direction of the slit; and a driving unit configured to perform the shape conversion by linearly driving the second support member supported by the plate-shaped member in the extending direction of the slit.

5. The liquid dispensing apparatus according to claim 3, wherein the bent shape conversion unit includes:

a first plate-shaped member having the first support member fixed to a surface thereof;

a second plate-shaped member having the second support member fixed to a surface thereof and including a slit linearly extending so as to allow the first support member fixed to the first plate-shaped member to be inserted, the second plate-shaped member being configured to be driven to linearly move in the extending direction of the slit relatively with respect to the first support member inserted in the slit; and a driving unit configured to perform the shape conversion by linearly driving the second plate-shaped member in the extending direction of the slit thereby linearly moving the second support member relatively with respect to the first support member in the slit.

6. The liquid dispensing apparatus according to claim 3, wherein the bent shape conversion unit includes:

a plate-shaped member having the first support member fixed to a surface thereof;

a frame member having the second support member fixed thereto and configured to be made to pivot by a rotational driving force, such that the position where the second support member is fixed is made to pivot about a rotation axis coinciding with a straight line on the plate-shaped member passing the position where the first support member is fixed; and a driving unit configured to perform the shape conversion by driving the frame member to pivot so as to make the second support member relatively pivot with respect to the first support member.

7. The liquid dispensing apparatus according to claim 1, wherein the control unit is configured to alternately perform the shape conversion and the reverse conversion at predetermined time intervals.

* * * * *